US007830344B2

(12) United States Patent
Yoshihara et al.

(10) Patent No.: US 7,830,344 B2
(45) Date of Patent: Nov. 9, 2010

(54) DISPLAY PANEL INCLUDING LIQUID CRYSTAL MATERIAL HAVING SPONTANEOUS POLARIZATION

(75) Inventors: Toshiaki Yoshihara, Akashi (JP); Tetsuya Makino, Kakogawa (JP); Hironori Shiroto, Akashi (JP); Yoshinori Kiyota, Kobe (JP)

(73) Assignee: Fujitsu Limited, Kawasaki (JP)

( * ) Notice: Subject to any disclaimer, the term of this patent is extended or adjusted under 35 U.S.C. 154(b) by 696 days.

(21) Appl. No.: 11/801,313

(22) Filed: May 9, 2007

(65) Prior Publication Data

US 2007/0211004 A1 Sep. 13, 2007

Related U.S. Application Data

(62) Division of application No. 09/824,436, filed on Apr. 2, 2001, now Pat. No. 7,233,306.

(30) Foreign Application Priority Data

Apr. 28, 2000 (JP) ..... 2000-131147

(51) Int. Cl.
*G09G 3/36* (2006.01)

(52) U.S. Cl. ..... 345/87; 345/204

(58) Field of Classification Search ..... 345/87–103, 345/204, 205, 209–214; 349/123, 129, 172
See application file for complete search history.

(56) References Cited

U.S. PATENT DOCUMENTS 4,870,486 A 9/1989 Nakagawa et al.
5,191,455 A 3/1993 Hashimoto et al.
5,252,954 A * 10/1993 Nagata et al. ..... 345/95
5,260,699 A 11/1993 Lister et al.
5,383,041 A 1/1995 Yamazaki et al.
5,436,742 A 7/1995 Tanaka et al.
5,537,129 A 7/1996 Okada et al.
5,724,057 A 3/1998 Kimura et al.
5,793,345 A 8/1998 Silverbrook
5,831,706 A * 11/1998 Lyu ..... 349/129
6,163,360 A * 12/2000 Tanaka et al. ..... 349/172
6,329,970 B2 12/2001 Kondoh
6,335,717 B2 1/2002 Hasegawa et al.
6,344,842 B1 2/2002 Hebiguchi
6,344,889 B1 * 2/2002 Hasegawa et al. ..... 349/123
6,348,910 B1 2/2002 Yamamoto et al.

(Continued)

FOREIGN PATENT DOCUMENTS

JP 62-028717 2/1987

(Continued)

*Primary Examiner*—Nitin Patel
(74) *Attorney, Agent, or Firm*—Greer, Burns & Grain, Ltd.

(57) ABSTRACT

There is provided a liquid crystal display including a panel using a liquid crystal material having spontaneous polarization, such as ferroelectroic liquid crystal (FLC), having a faster response time suitable to display dynamic images. The FLC has the disadvantage caused by the incomplete memory effect at during driving for displaying "black" in several frames, where the light transmittance is preferably desired zero. The panel in the display are driven signals so that the driving signals are applied across the picture element, where the signals are positively or negatively offset to reference voltage of the panel.

3 Claims, 10 Drawing Sheets

U.S. PATENT DOCUMENTS

| | | | | |
|---|---|---|---|---|
| 6,489,952 | B1 | 12/2002 | Tanaka et al. | |
| 6,762,812 | B2 * | 7/2004 | Hasegawa et al. | 349/132 |
| 2001/0011986 | A1 | 8/2001 | Kondoh | |
| 2001/0026259 | A1 | 10/2001 | McKnight | |
| 2001/0026340 | A1 * | 10/2001 | Hasegawa et al. | 349/123 |
| 2003/0040738 | A1 * | 2/2003 | Ruiz et al. | 606/5 |
| 2008/0055218 | A1 * | 3/2008 | Tsuda et al. | 345/87 |

FOREIGN PATENT DOCUMENTS

| | | |
|---|---|---|
| JP | 63-133125 | 6/1988 |
| JP | 63-306426 | 12/1988 |
| JP | 63-309928 | 12/1988 |
| JP | 10-96896 | 4/1989 |
| JP | 05-002376 | 1/1993 |
| JP | 5-107541 | 4/1993 |
| JP | 05-119746 | 5/1993 |
| JP | 06-242419 | 9/1994 |
| JP | 07-168156 | 7/1995 |
| JP | 07-248484 | 9/1995 |
| JP | 07-294874 | 11/1995 |
| JP | 08-171083 | 7/1996 |
| JP | 08-234172 | 9/1996 |
| JP | 8-313876 | 11/1996 |
| JP | 09-043574 | 2/1997 |
| JP | 9-203901 | 8/1997 |
| JP | 9-211425 | 8/1997 |
| JP | 10-010495 | 1/1998 |
| JP | 10-031203 | 2/1998 |
| JP | 11-064822 | 3/1999 |
| JP | 11-084339 | 3/1999 |
| JP | 2001-234179 | 8/2001 |

* cited by examiner 130
a frame
131
sub-frame
white
sub-frame
black
132
FIG. 1A1
101
FIG. 1A2
102
FIG. 1A3
103
FIG. 1A4
104
FIG. 1A5
105
FIG. 1A6
106
111 112 113 114
116
115'
116'

0V
115
111' 112' 113' 114'

0V
FIG.1D1
0V
FIG.1D2
0V
FIG.1D3
0V
FIG.1D4
0V
FIG.1D5
0V
FIG.1D6
0V 230
231
white
black
231'
232'
232
FIG. 4A1
201
FIG. 4A2
202
FIG. 4A3
203
FIG. 4A4
204
FIG. 4A5
205
FIG. 4A6
206
211 212 213 214
216
215'
216'

0 V
215
211' 212' 213' 214'

0 V
ΔVofs
FIG.4D1
FIG.4D2
FIG.4D3
FIG.4D4
FIG.4D5
FIG.4D6

FIG. 10A1
FIG. 10A2
FIG. 10A3
FIG. 10A4
FIG. 10A5
FIG. 10A6

0 V
ΔVofs

0 V
FIG.10D1
0 V
ΔVofs
FIG.10D2
0 V
ΔVofs
FIG.10D3
0 V
ΔVofs
FIG.10D4
0 V
ΔVofs
FIG.10D5
0 V
ΔVofs
FIG.10D6
0 V
ΔVofs

DISPLAY PANEL INCLUDING LIQUID CRYSTAL MATERIAL HAVING SPONTANEOUS POLARIZATION

This is a divisional of application Ser. No. 09/824,436, filed Apr. 2, 2001 now U.S. Pat. No. 7,233,306.

BACKGROUND OF THE INVENTION

1. Field of the Invention

This invention relates to liquid crystal devices, and particularly to devices using liquid crystal having spontaneous polarization such as ferroelectric or antiferroelectric liquid crystal materials.

2. Description of Related Art

In recent years, the research on liquid crystal has rapidly progressed, resulting in increase of its application to devices, such as a display panel, an optical modulator, and an optical shutter in printing machine and so on.

In particular, liquid crystal devices and liquid crystal panels are characterized by thin depth, a lightweight, and low consumption. Hence, the devices or the panels are used as a display unit in various kind of devices, such as mobile terminals, for example cellular phones and mobile computers, moreover desk-top computers or household television sets.

The configuration of a liquid crystal display panel generally has a pair of opposing substrates spaced appropriately apart, including electrodes on inner faces of these substrates for switching each picture element or pixel defined by the arrangement of electrodes. Liquid crystal material is filled in a space between these substrates which are sealed at their periphery, while the detailed configurations are described later.

The widely used liquid crystal materials used these days for the liquid crystal display devices are; super twisted nematic liquid crystal and twisted nematic liquid crystal, which are hereinafter referred to as STN and TN respectively. The liquid crystal display of STN driven through a simple-matrix-type electrode configuration, which is referred to as simple matrix, is liable to generate image degradation caused by electrical cross-talk between picture elements or pixels, while the relatively low manufacturing cost results from the use of the simple matrix. The liquid crystal display of STN driven through the simple matrix also has undesirable response time (slow response time) for displaying dynamic images such as moving pictures.

On the other hand, TN in devices may be driven through an active-matrix-type electrode configuration including thin film transistors as switching elements, where the configuration is referred to as active matrix.

The liquid crystal display device of TN driven through the active matrix generally has no problem of electrical cross-talk, hence its image quality is better than that produced by the liquid crystal display device of STN driven through the simple matrix. The liquid crystal display device of TN further has faster response time than that of the liquid crystal display of STN, however the response time is limited by the characteristics of material itself, which means the liquid crystal display of TN being unsuitable for a display panel required to respond at high speed for displaying dynamic images such as motion picture.

These two materials have a common problem of a narrow view angle, hence the preferable view direction to see images on the display using these materials is limited.

It is well known that a certain type of liquid crystal material has spontaneous polarization, and a ferroelectric liquid crystal, which is referred to as FLC hereinafter, is a representative one of this type. This type of liquid crystal material is characterized by its fast response time ranging from several to several hundred microseconds, which is approximately one hundred times faster than that of TN liquid crystal. Therefore, this type of material may solve the problem related to the response time.

The FLC also has a characteristic such that liquid crystal molecules of the FLC always maintain their axis parallel to an appropriately treated surface of a substrate contacting the crystal. This characteristic leads to extremely smaller variation of index of refraction of the crystal according to view direction than that of TN or STN liquid crystals, resulting in a wider viewing angle of display panels using FLC material. Therefore the FLC material also has the advantage suitable for the liquid crystal as the material for a display panel.

However, the FLC material has a disadvantage such as a decrease of contrast ratio (or low contrast ratio) when used as the material for the display panel. The decrease comes from incompleteness of the memory effect during data being maintained in a picture element, where data corresponds with whether the light transmittance of the material in the element is low or high. That is, a little increase of the light transmittance in the picture element occurs when data pulses of zero amplitude for displaying "black" during several frames are applied to the element, and a little amount of light from a light source leaks through the element, resulting in decreasing the contrast ratio.

Therefore, the prevention of the increase of the light transmittance during displaying "black" is desired for improving the contrast ratio of the display panel using the FLC material.

SUMMARY OF THE INVENTION

There is provided a liquid crystal display including a panel using a liquid crystal material having spontaneous polarization, such as ferroelectric liquid crystal (FLC), having a faster response time suitable to display dynamic images. The FLC has the disadvantage caused by the incomplete memory effect during driving for displaying "black" in several frames, where the light transmittance is preferably desired to be zero. To prevent the decrease of contrast ratio caused by the incomplete memory effect, the panel in the display is driven by signals so that the driving signals are applied across the picture element, where the signals are positively or negatively offset with respect to the reference voltage of the panel.

In one aspect of the present invention, a disadvantage such as decrease of contrast ratio (or low contrast ratio) when used as the material for the display panel is improved by use of an improved driving. The improved driving may shift the voltage appearing across a picture element to a positive or negative voltage from the reference potential of the panel.

In another aspect of the present invention, there is provided a crystal display panel such that a voltage applied to a common electrode provided on a face of an substrate is offset positively or negatively to improve the contrast ratio.

In a further aspect of the present invention, there is provided a liquid crystal display panel such that data signal applied to data signals electrode are offset positively or negatively to improve the contrast ratio.

In still further aspect of the present invention, there is proved a liquid crystal display panel such that full color dynamic images are displayed, without color filter, by use of a light source which can emit each light of three primary colors.

BRIEF DESCRIPTION OF THE DRAWINGS

FIGS. 1A1 to 1A6 schematically show signal waveforms applied to scanning bus lines;

FIGS. 1D1 to 1D6 schematically show waveforms of voltage appearing across each picture element driven by corresponding data signal shown in FIG. 1B;

FIGS. 4A1 to 4A6 schematically show signal waveforms applied to scanning bus lines;

FIGS. 4D1 to 4D6 schematically show waveforms of voltage appearing across each picture element driven by corresponding data signal shown in FIG. 4B;

FIG. 6 shows a performance of voltages applied to a picture element vs. light transmittance;

FIGS. 10A1 to 10A6 schematically show signal waveforms applied to scanning bus lines;

FIGS. 10D1 to 10D6 schematically show waveforms of voltage appearing across each picture element driven by corresponding data signal shown in FIG. 10B.

DETAILED DESCRIPTION OF THE PREFERRED EMBODIMENT

Figure 3A:
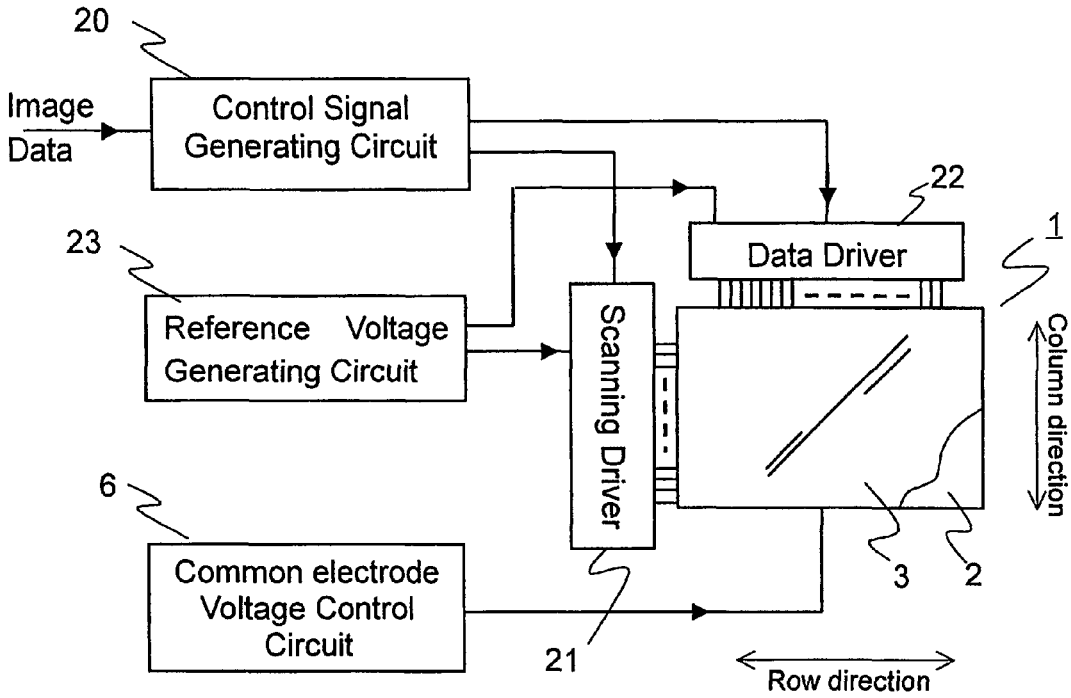
FIG. 3A schematically shows a block diagram of a liquid crystal display panel with circuits as the first preferred embodiment.
Figure 3B:
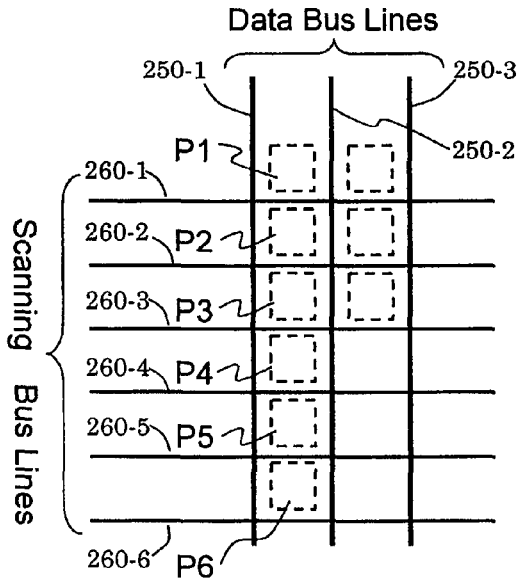
FIG. 3B schematically shows a relationship between six picture elements and data bus and scanning lines.

Referring to FIG. 1, the schematic waveforms are shown in case of a liquid crystal display using FLC material which is driven through the active matrix, where six picture elements P1 to P6 arranged on a same column direction as shown in FIG. 3B are driven for example.

Figure 6:
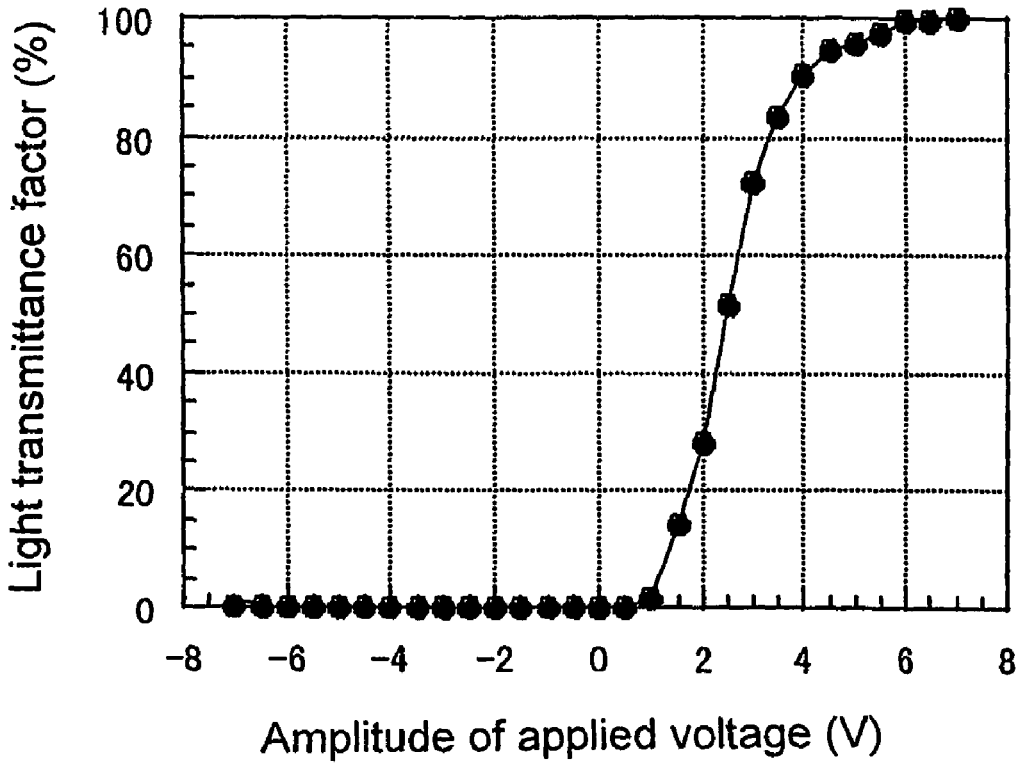

More in detail, each of FIGS. 1A1 to 1A6 schematically show gate pulses or scan pulses 101 to 106 applied to relevant scanning bus line respectively. Each of the scanning bus lines is electrically connected to each gate electrode of thin film transistors (TFTs) as switching devices in the active matrix. During the application of the gate pulse 101, for example, to a scanning bus line the relevant TFTs turn on, and turn off if there is no application of the gate pulse. As shown in FIGS. 1A1 to 1A6, the gate pulses 101 to 106 are applied in sequence to each scanning bus line, hence these gate pluses 101 to 106 sequentially scan from the first scanning bus line to the last scanning bus line, while FIGS. 1A1 to 1A6 show only six gate pulses for six row lines for example.

Figures 1B, 1C:
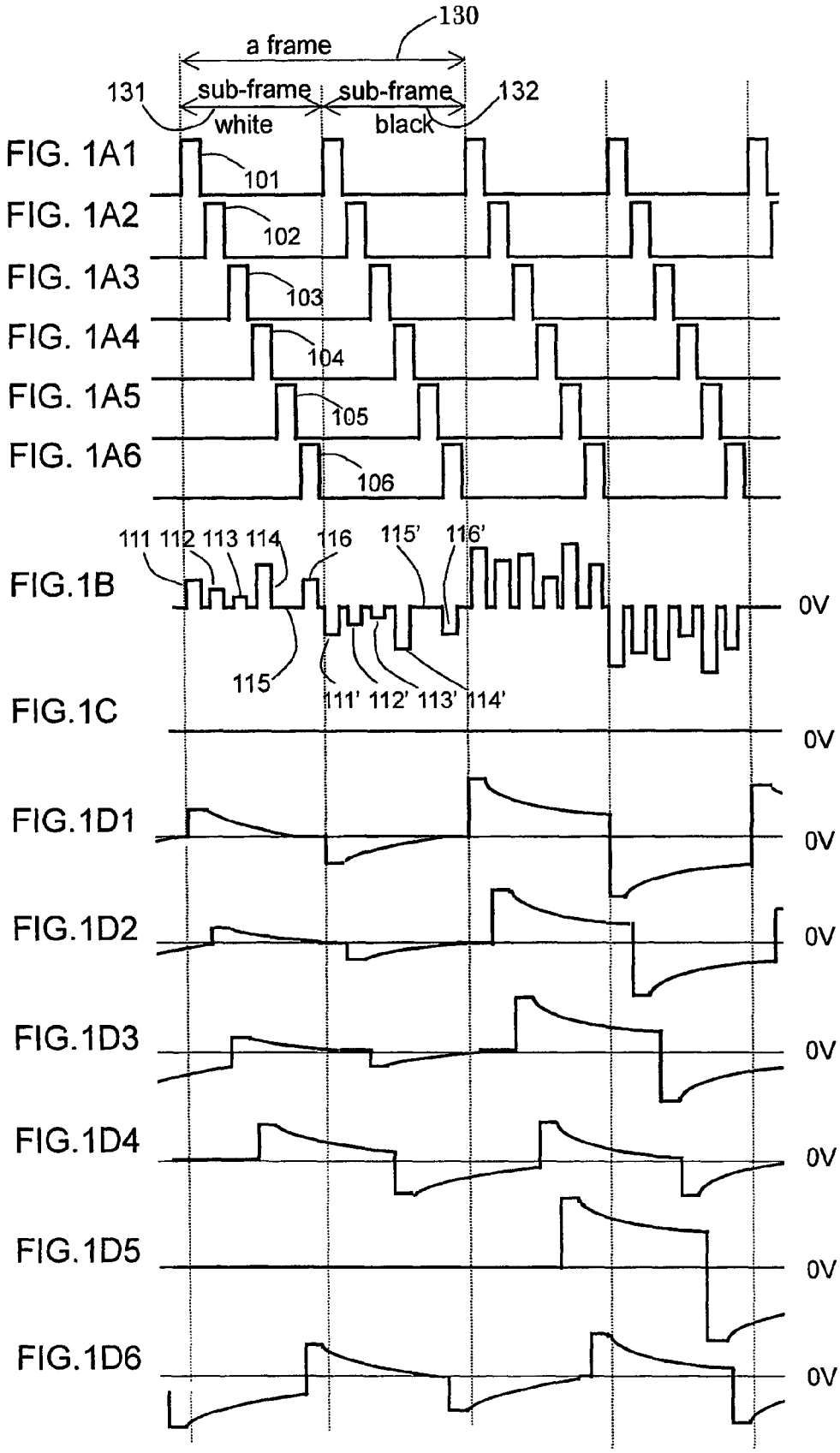
FIG. 1B schematically shows data signals applied a data bus line.
FIG. 1C schematically shows a common voltage applied to a common electrode.

FIG. 1B schematically shows the data signals 111 to 116 and 111' to 111' during a one frame, which is described in detail hereinafter, to be applied to each of the six picture elements P1 to P6 for controlling the electrical potential occurring across the picture element P1 to P6 in synchronism with on or off state of the TFTs driven by the gate pulses 101 to 106 shown in FIGS. 1A1 to 1A6. The data signal 111 during a sub-frame 131, which is described in detail hereinafter, in synchronism with the gate pulse 101 shown in FIGS. 1A1, is applied to the relevant picture element P1.

FIG. 1C shows an electrical potential set to 0 V of a common electrode provided on an inner face of substrate opposing to the substrate having the active matrix, where a pair of these substrates are arranged so that the common electrode facing to the active matrix and the FLC material is provided between these substrates.

FIGS. 1D1 to 1D6 show each variation in time of electrical potentials occurring across liquid crystal in the picture elements P1 to P6 respectively. In FIG. 1B, the pulses 111 to 116, which are in the sub-frame 131, may set the FLC material in the picture element P1 to P6 except P5 in light transmissible mode in this case, which means the light may pass through the picture element P1 to P4 and P6, hence the sub-frame 131 is called as a white sub-frame or a white writing sub-frame. The pulses 111' to 116', which are in a sub-frame 132, may reset the FLC material in the picture element P1 to P6 into block mode in this case, which ideally means light cannot pass through the device, hence the sub-frame 132 is called as a black sub-frame or a black writing sub-frame. A frame 130 comprises these sub-frames 131 and 132.

On the contrary to this case, it is possible to arrange the display according to polarizer films provided on the outer faces of substrates so as to set the elements P1 to P6 in the block mode, while the polarity of data signals 111 to 116 are same in FIG. 1B. Similarly, the elements P1 to P6 except P5 driven by the signal data 111' to 114' and 116' respectively can be set as the light transmissible modes.

From the view point of driving a liquid crystal and a reliability of a pulse generator for generating data signals applied to the liquid crystal, it is preferable that each amplitude of data signal in the white sub-frame 131 preferably be inversely equal to corresponding amplitudes of the data signal in the black sub-frame 132, and the liquid crystal is driven in a order of white writing and black writing, as shown in FIG. 1B.

Therefore, a picture element desired to display "black" in the white writing sub-frame should be kept at 0 V during both sub-frames periods.

Figure 2:
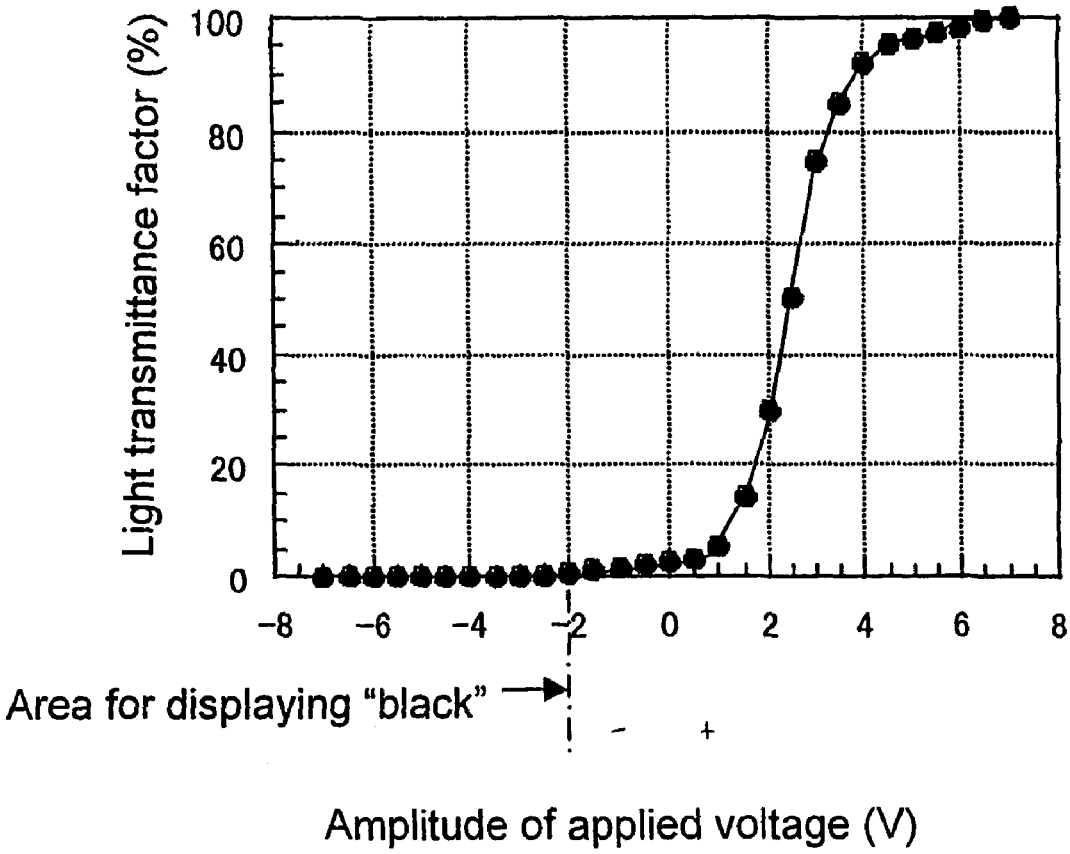
FIG. 2 schematically shows a diagram of light transmittance factor of the liquid crystal display panel driven by the signals shown in FIG. 1.

FIG. 2 shows the relationship between applied voltage across the picture element and the light transmittance factor of the picture element driven by the waveforms in FIGS. 1A to 1C. FIG. 2 shows that a little amount of light, such as the light emitted from a light source arranged behind the liquid crystal panel, passes through the picture element at 0 V which is a voltage of data signal, therefore −2 V should be applied across the picture element for light transmittance practically being zero.

In the period of the white sub-frame 131 the minimum amplitude of pulse is 0 V and setting the amplitude negative is not preferable according to above reason, that is, the reliability of pulse generator. Therefore in this case of setting the pulse amplitude to 0 V, the picture element in turn in the black sub-frame 132 can not display "black", because of the light transmittance being not zero.

The object of the present invention provides liquid crystal devices which have the improved contrast ratio by preventing a little light transmission through picture elements caused by the incompleteness of memory effect of the liquid crystal material having spontaneous polarization when data are written thereon.

The present invention provides liquid crystal devices characterized by improved contrast ratio which is attained by compensating the incompleteness of memory effect of the ferroelectric material when data is written thereon and maintaining the state of the light transmittance being almost zero. The compensation can be realized by offsetting the potential applied to one of electrodes which supplies a voltage to the picture element so that the devices display "black" or block mode.

Figure 3C:
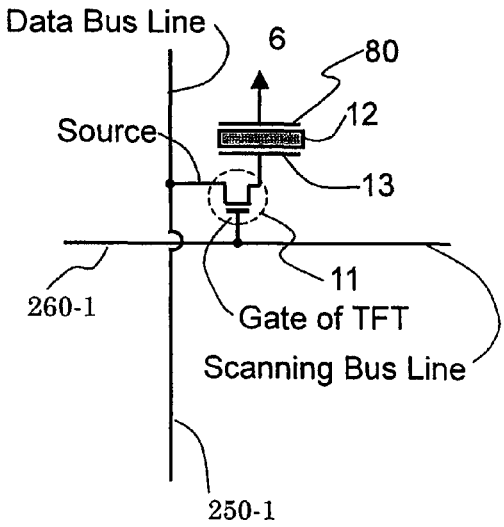
FIG. 3C schematically shows an equivalent circuit corresponding to a picture element.

FIG. 3A shows a block diagram of a liquid crystal display device including the improved driving system as the first preferred embodiment of the present invention, FIG. 3B shows the relationship between the six picture elements, the data bus lines, and the scanning bus lines. FIG. 3C shows an example of an equivalent circuit of one picture element which comprises a TFT 11 whose gate and source are electrically connected to a scanning bus line and a data bus line respectively in this embodiment. The drain of the TFT 11 is electrically connected to a display electrode 13. The FLC is provided between the display electrode 13 and a common electrode 80, in this embodiment.

The liquid crystal display panel 1 shown in FIG. 3A comprises two substrates 2 and 3, where the active matrix is formed on the inner face of the substrate 2 and the common electrode 80 is formed on the inner face, opposing to the active matrix, of the substrate 3. A common electrode voltage control circuit 6 serves as a controlled offset voltage supplier which supplies a controlled voltage to the common electrode 80. A reference voltage generating circuit 23 generates a reference voltage for defining the reference potential of the panel 1.

Image data from an external device (not shown) are inputted into a control signal generating circuit 20 and stored in memory provided within the circuit 20. The image data then are converted to respective pixel data corresponding to each picture element in the panel 1. The pixel data in turn are sent to a data driver 22 in which the pixel data are converted to serial data for each line and written to a corresponding data bus line, while a synchronizing signal is sent from the circuit 20 to a scanning driver 21 for generating scanning pulses by which the gates of TFTs connected to each of data bus lines are turn on. The scanning pulses are sequentially input to each scanning bus lines.

Each data signal inputted to data bus line can apply the voltage of data signal across each picture element during the gate of the TFT 11, in the relevant picture element, being turned on.

Figures 4B, 4C:
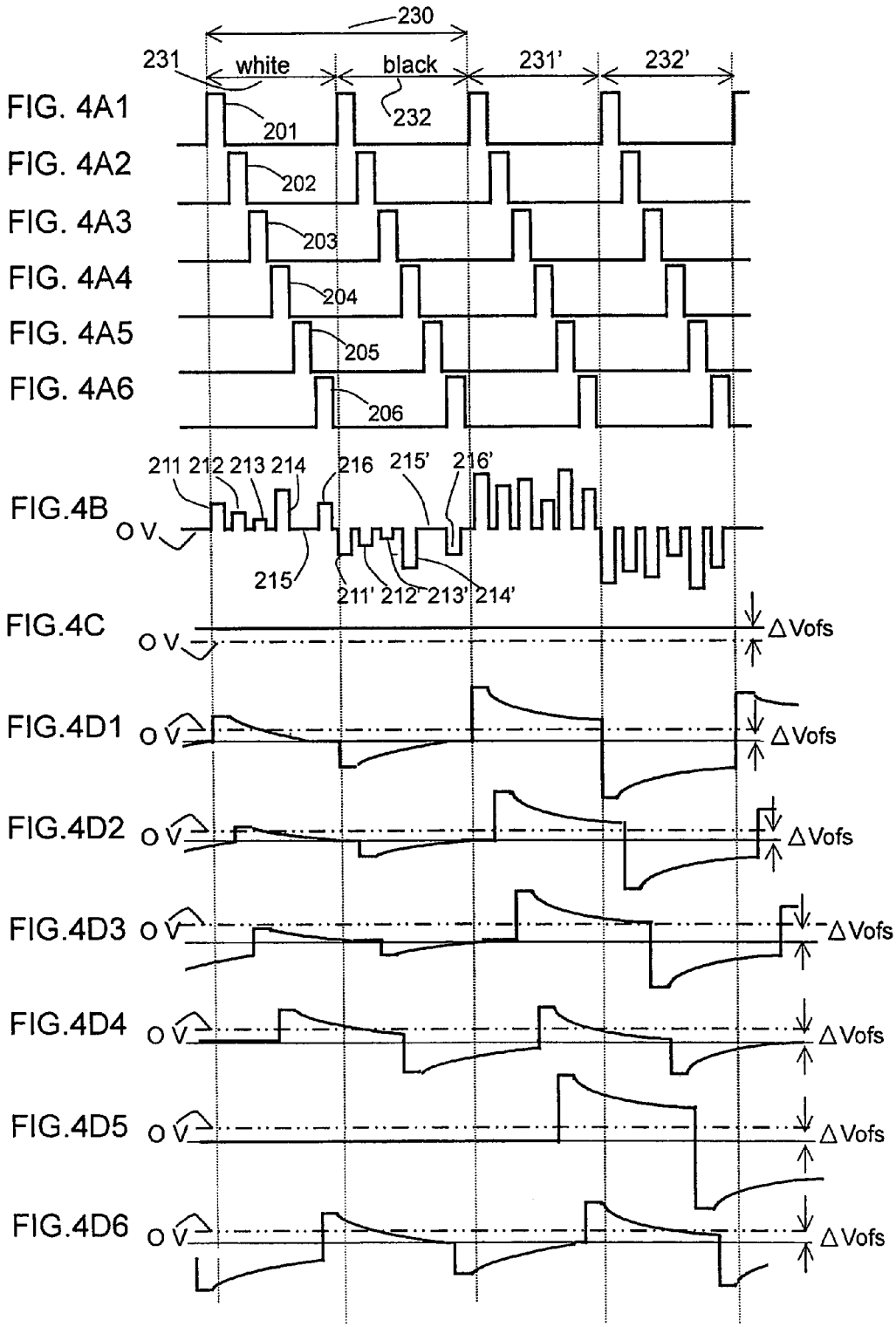
FIG. 4B schematically shows data signals applied a data bus line.
FIG. 4C schematically shows a common voltage applied to a common electrode.

Referring to FIGS. 4A1 to 4A6, these signals are applied to scanning bus lines relayed to six picture elements arranged on a same data bus line as similar as in the case of FIG. 1. The pulses 201 to 206 are scanning pulses which are applied to corresponding scanning bus lines. FIG. 4B shows a pulse train of signals for six picture elements P1 to P6, for example, which are applied in synchronism with the relevant scanning pulses 201 to 206. FIG. 4C shows a voltage offset for compensation of the incompleteness of memory effect of the FLC. And FIGS. 4D1 to 4D6 show each potential appeared across each picture elements P1 to P6 when the data signals 211 to 216, 211' to 216', 221 to 226, 221' to 226' in FIG. 4B respectively during each sub-frame.

As shown in FIG. 4C, the common electrode voltage control circuit 6 supplies the common electrode 80 with the voltage Δ Vofs which is offset from the reference level in the panel 1 so as to provide a stable "black" presentation, where in this embodiment Δ Vofs has a positive polarity. The data signals 211 to 216, 211' to 216', 221 to 226, and 221' to 226' as shown in FIG. 4B, are applied to data bus lines for energizing each corresponding picture element P1 to P6 during the relevant TFT being turned on by the corresponding gate scanning pulses 211 to 216. As described above, as well in the first preferred embodiment each data signal for a picture element in sub-frame 231 for writing "white" and sub-frame 232 for writing "black" in a frame 230 respectively has opposite polarity and same amplitude.

Figure 5:
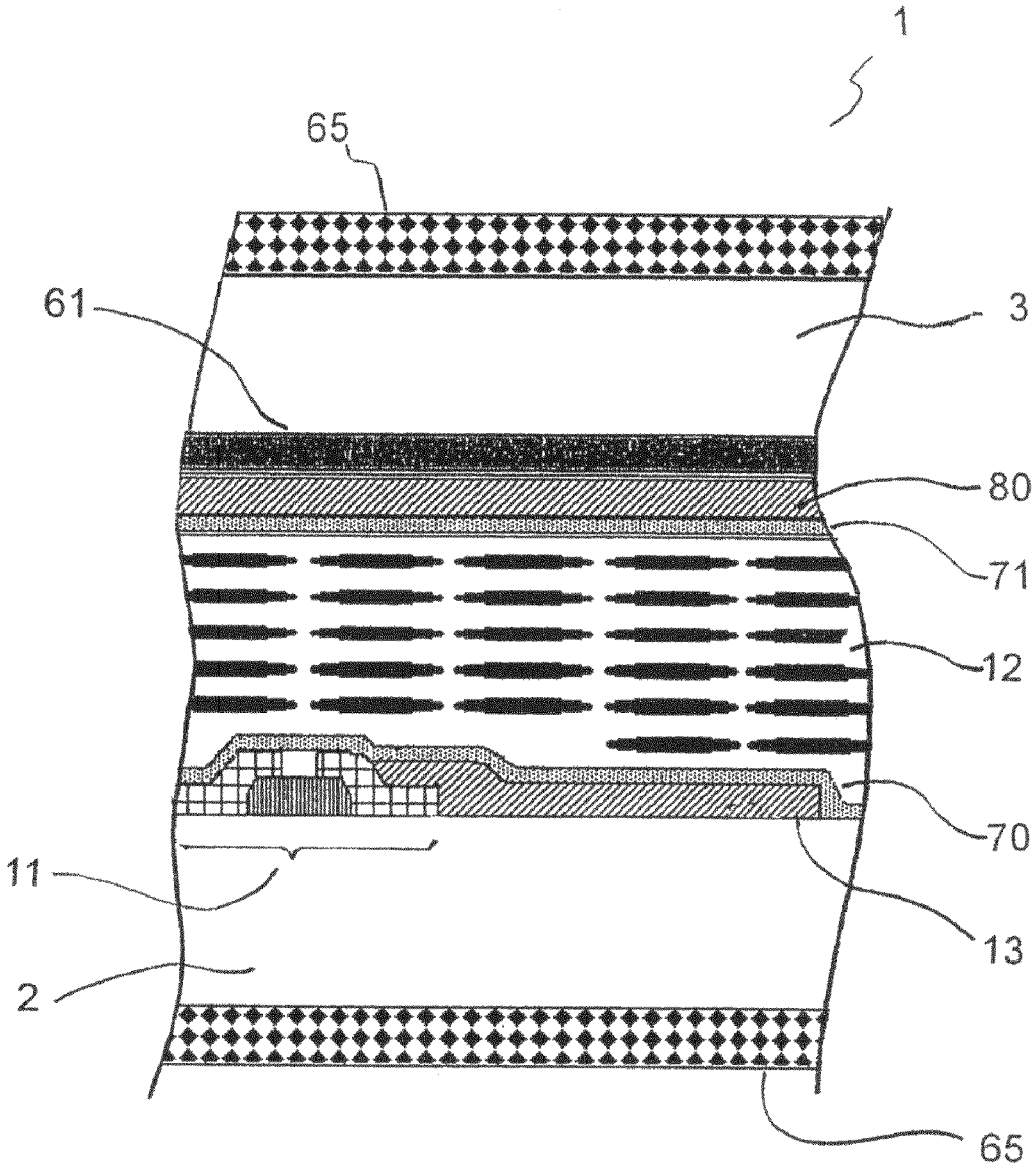
FIG. 5 schematically shows a cross section of essential part of a liquid crystal display panel shown in FIG. 3.

FIG. 5 shows a cross section of an essential part in the panel 1 as the first preferred embodiment of the present invention. The active matrix including TFT 11 and display electrode 13 are provided on the substrate 2 of glass, color filters 61 and common electrode 80, which is transparent electrodes made of, for example, tin oxide, are provided on a substrate 3 of glass.

On one face of the substrate 2 there is provided the active matrix for the liquid crystal panel size of a 12.1-in. diagonal in which pixel pitches in row and column direction are 0.1025 and 0.3075 mm respectively, and the number of pixels is 800×3×600, where a pixel comprises three picture elements or sub-pixel which are arranged in row direction, therefor the pixel is of a square (0.1025×3 by 0.3075 mm). On one face of the substrate 3 there is provided a common electrode 80 deposited over a color filter 61 composed of sub-filters for three colors of red, green, and blue which are formed at the same pitches (0.1025 mm) in the row direction in this embodiment.

A thin layer of polyimide is coated on a face with the active matrix of substrate 2 and on a face over the color filter 61 on the substrate 3, after washing the substrates 2 and 3. After appropriate treatments, such as cure or baking, the surfaces of the layers of 20 nm thick become alignment layers 70 and 71 after being buffered or rubbed in a single direction by a soft cloth, such as rayon.

Opposing each of the alignment layers 70 and 71, the substrates 2 and 3 spaced by distributed spacers made of silica of about 1.6 μm in average particle size are sealed along the periphery thereof. And then, the ferroelectric liquid crystal material 12 including naphthalic liquid crystal as the chief ingredient (A. Mochizuki, et. al: Ferroelectrics, 133,353,(1991)) is filled in the space between the substrates 2 and 3.

Each polarizer film 65 (Nitto-Denko: NPF-EG1225DU) is provided on each outer surface of the sealed substrates 2 and 3 so as to keep the relation of cross nicols condition each other, where black is presented when the longitudinal axis of molecule of the ferroelectric liquid crystal is tilted by the application of negative voltage to the data bus line.

The panel 1 formed in these steps above described is driven in a way as follow.

A voltage from the common electrode voltage control circuit 6, which is positively offset by about Δ ofs=1 V from the reference potential supplied from the reference voltage generating circuit 23, is applied to the common electrode 80 for stabilizing the presentation of "black" as shown in FIG. 4C.

Each picture element is energized through the data electrode during the TFT 11 being on. And a pair of data signals of opposite polarity and same amplitude, for example 211 and 211' in FIG. 4B, are applied to each picture element in the period of the sub-frames, such as 231 and 232, 231' and 232', for writing white and writing black respectively in each single frame 230.

FIG. 6 shows performance of the liquid crystal display 1, exhibiting light transmittance factor on basis of amplitude of data signal during application of data bus line. It shows that the light transmittance is almost nearly zero when the voltage applied to the data electrode is 0 V. This preferable performance comes from applying voltage positively offset to the common electrode 80. Each electrical potential appearing across a picture element is shown in FIGS. 4D1 to 4D6. Both amplitude of data signal 215 and 215' are 0 V for displaying black, while the effective potential applied across the pixel is negative during the sub-frames 231 and 232 in FIG. 4D5 so as to produce 0 of light transmittance factor. The measured contrast ratio, which is defined as the ratio between light transmittances in displaying white and black, is 220:1, where the amplitude of data signal applied to picture element is 0 V at black presentation and 7 V at white presentation.

These contrast ratio shows that the display panel 1 may be preferably used as a display device.

Figure 7:
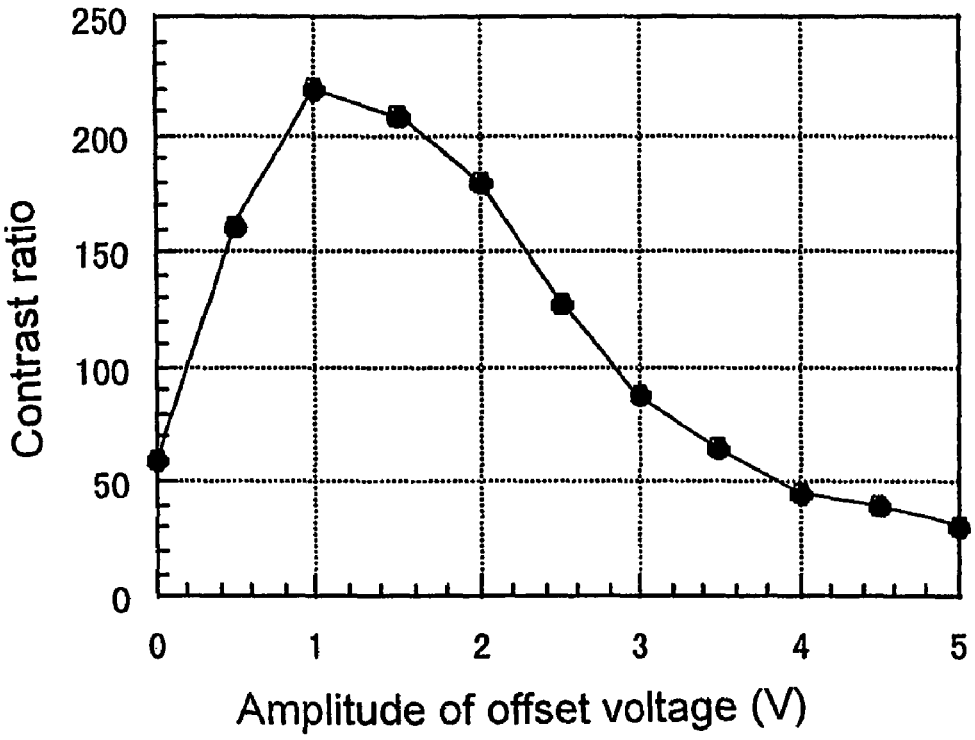
FIG. 7 shows a performance of voltages applied to a common electrode vs. contrast ratio.

Furthermore, FIG. 7 shows a variation of contrast ratio of this display panel 1, where the amplitude of offset voltage, Δ ofs applied to the common electrode 80 has been selected in the range 0 to 5 V. The ratio was calculated from the light transmittance factor at black presentation (amplitude of data signal: 0 V) and at white presentation (amplitude of data signal: 7 V), while the amplitude of the offset voltage is selected in the range 0 to 5 V. If the desired contrast ratio is more than 100:1, the sufficient contrast ratio is performed in this display panel 1 in the range of 0.5 to 2 V of the offset voltage.

When the panel 1 was driven by the conventional way, where the common electrode was kept at 0 V, the contrast ratio became to 60:1.

Figure 8:
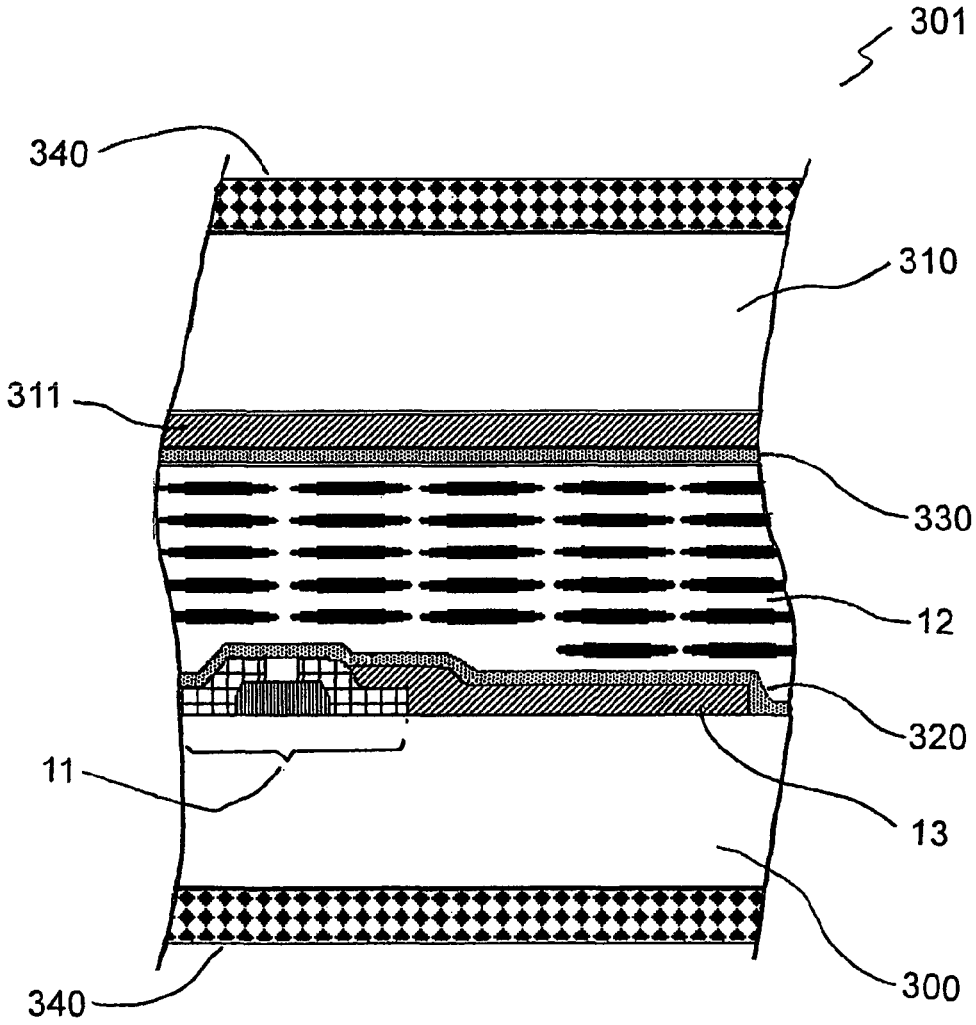
FIG. 8 schematically shows a cross section of essential part of a liquid crystal display panel as the second preferred embodiment.

Now referring to FIG. 8, the second preferred embodiment is shown. This cross section is of an essential part in a liquid crystal panel 301.

On one face of the substrate 301 there is provided an active matrix for the liquid crystal panel size of a 12.1-in. diagonal in which pixel pitches in line and column direction are 0.3075 and 0.3075 mm respectively, and the number of picture elements is 800×600. There is provided a transparent common electrode 311 deposited over one of faces of the substrate 310. A thin layer of polyimide has been coated on each face of the active matrix and face transparent common electrodes of the washed substrates 300 and 310 respectively. After appropriate treatment, such as cure or baking, each surface of the cured layer of 20 nm thick becomes alignment layers 320 and 330 respectively after buffered or rubbed in a single direction by a soft cloth, such as rayon.

Opposing each of alignment layers 320 and 330, the substrates 300 and 310 spaced by distributed spacers made of silica of about 1.6 μm in average particle size are sealed along periphery thereof. And then, the ferroelectric liquid crystal material 360 including naphthalic liquid crystal as the chief ingredient (A. Mochizuki, et. al: Ferroelectrics, 133,353,(1991)) is filled in the space between the substrates 300 and 310.

Each of polarizer films 340 (Nitto-Denko: NPF-EG1225DU) is provided on each outer surface of the sealed substrates 300 and 310 so as to keep the relation of cross nicols condition each other, where black is presented by tilting of the longitudinal axis of molecule of the ferroelectric liquid crystal.

Figure 9A:
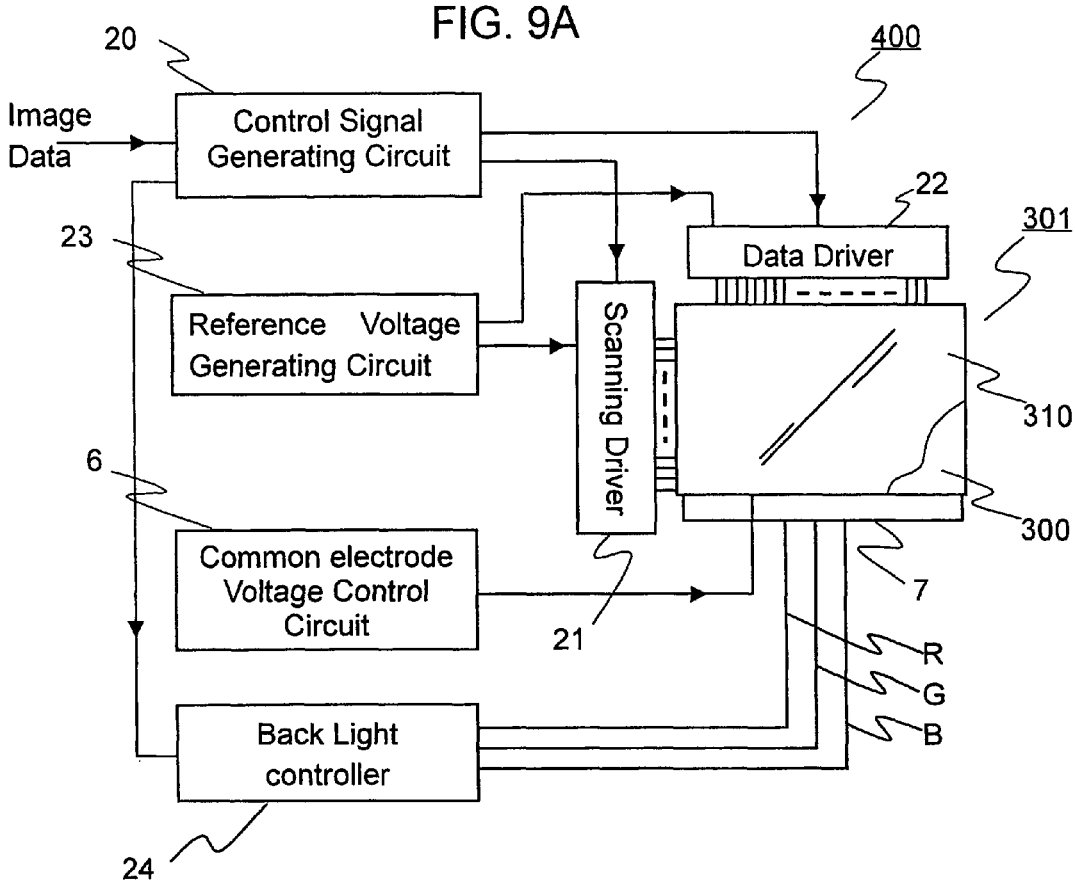
FIG. 9A schematically shows a block diagram of a liquid crystal display panel with circuits as the second preferred embodiment.
Figure 9B:
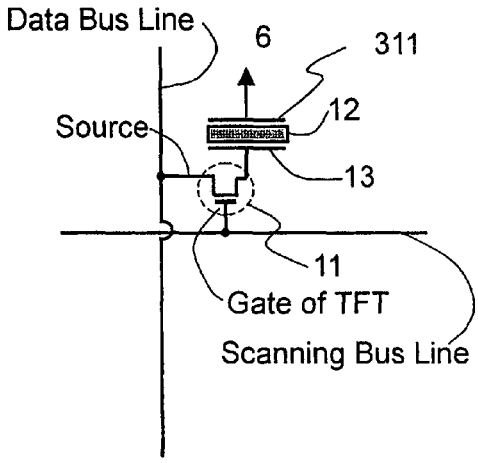
FIG. 9B schematically shows an equivalent circuit corresponding to a picture element.

FIG. 9A shows a block diagram of the liquid crystal display 400 in the second preferred embodiment, where a part having same reference number as one in FIG. 3A has a similar function. FIG. 9B shows an equivalent circuit for a picture element. A liquid crystal display 400 has a back light source 7 which comprises light emitted diodes and can emit each monochromatic light of red, blue, and green time divisionally and is located behind the panel 301, that is, behind the second substrate 300. The source 7 is driven for emitting each color by driving signals from a back light controller 24 on basis of the synchronizing signal from the circuit 20, resulting in emitting each color in synchronism with panel operation, such as scanning operation.

A voltage, which is positively offset by about 1 V from the reference potential supplied from the reference voltage generating circuit 23, is applied to the common electrode 311 for stabilizing the displaying "black" as shown in FIG. 4C. Each of data signals shown in FIG. 4B is applied to the display electrode 13 through the data bus line during the TFTs 11 being turned on. And data signals of opposite polarity and same amplitude are applied alternately to a pixel by 180 Hz in the period of each pair of sub-frame for white-writing and black-writing in a single frame.

In this embodiment, a full color presentation is composed of three frames, each of which is used for presentation of a chromatic color. In synchronism with each frame, the source 7 is energized to emit a corresponding color alternately, where the lighting method is well known as a field sequential method. The desirable full color images are dynamically and clearly presented.

Comparing the panel 301 with the panel 1 in the first embodiment, the number of picture elements of the panel 301 in the second embodiment becomes ⅓ of the number of picture elements of the panel 1 in the first embodiment, while the panel sizes are the same. Resultant increase of each aperture area of the picture element together with no use of color filters gives effect to present bright images.

The second preferred embodiment uses the field sequential lighting method, hence it is necessary to drive each picture three times faster than the panel 1 using three color filter. However the use of the ferroelectric liquid crystal material characterized with fast response can realize to present images at 180 Hz of frame frequency, while it is difficult to use the conventional TN material at such high rate.

Figures 10B, 10C:
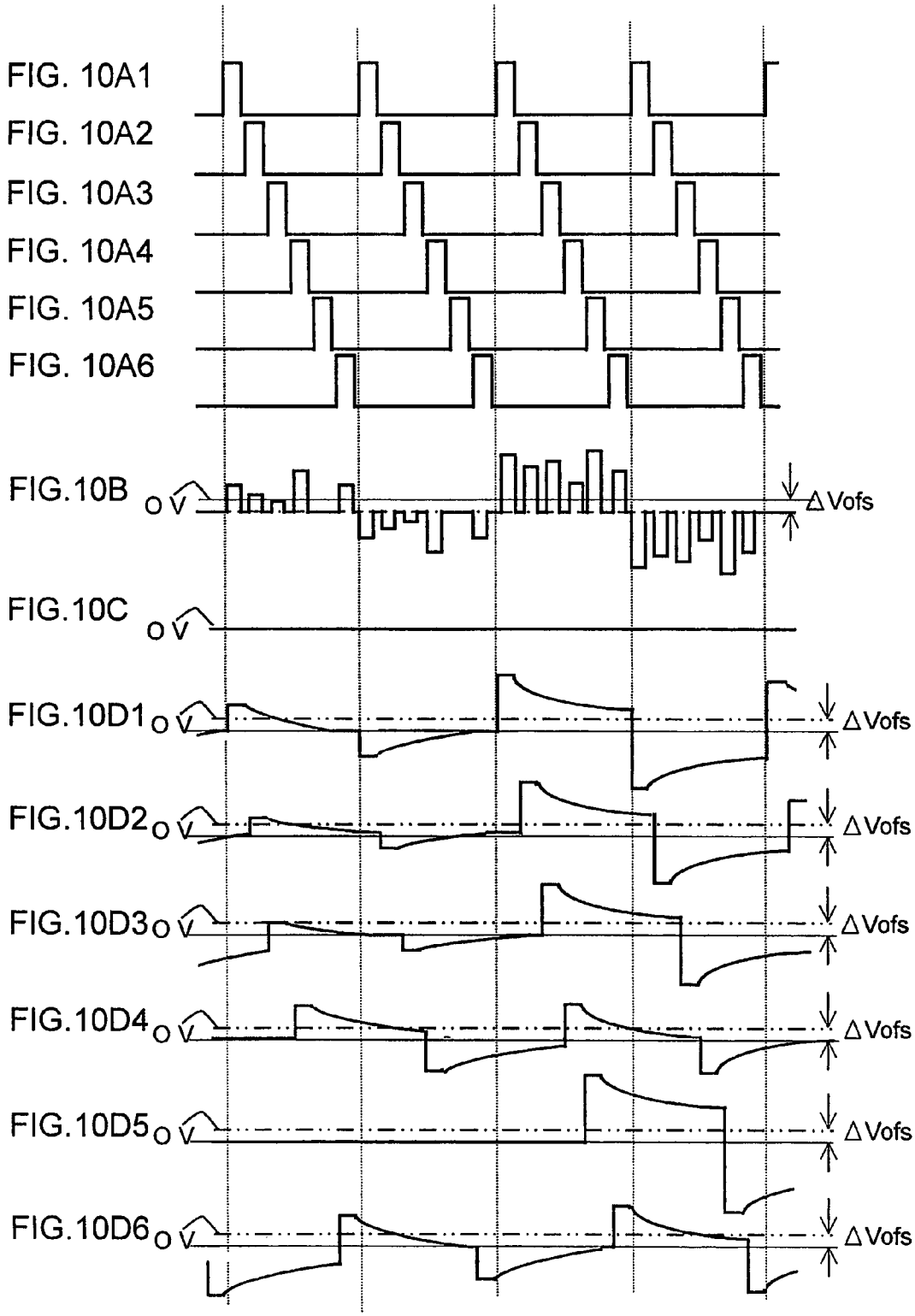
FIG. 10B schematically shows data signals applied a data bus line.
FIG. 10C schematically shows a common voltage applied to a common electrode.

With reference to FIG. 10, the third preferred embodiment is shown. The panel 1 in the first preferred embodiment is driven by the signals shown in FIGS. 10A1 to 10A6, 10B, and 10C. That is, a voltage of 0 V is applied to the common electrode as shown in FIG. 10C, and each of data signals offset negatively by 1 V is applied to the data bus line as shown in FIG. 10B. In this case, each voltage appearing across the picture element is shown in FIGS. 10D1 to 10D6, which are similar to each in FIGS. 4D1 to 4D6 respectively. This leads to a similar performance according to the contrast ratio. The driving method in the third preferred embodiment is applicable to a liquid crystal display panel which has no common electrode, such as a panel driven through a simple matrix.

From the first to third preferred embodiments, each of the display panels includes the active matrix and ferroelectric liquid crystal material. However, the present invention may be applicable to the display panel which includes a simple matrix, and to devices such as optical modulators or optical shutter therein.

As shown above, the present invention provides the display panel which has the improved contrast ratio resulting from preventing the increase of the light transmittance after data writing into the panel, where the increase is caused by the incompleteness of memory effect of ferroelectric liquid crystal panel at data writing.

While various embodiments of the present invention have been shown and described, it should be understood that other modifications, substitutions and alternatives may be apparent to one of ordinary skill in the art. Such modifications, substitutions and alternatives can be made without departing form the spirit and scope of the invention, which should be determined from the appended claims.

Various features of the invention are set forth in the appended claims.

What is claimed is:

1. A liquid crystal device comprising:

a common electrode being formed on an inner surface of either one of two substrates, said two substrates being opposed to each other, a common voltage being applied to said common electrode; and a liquid crystal material characterized by spontaneous polarization, being filled between said two substrates and being responsive to an applied signal for writing data and controlling a light transmittance of said material, wherein an offset voltage of said signal, corresponding to an image to be displayed and switched is offset to either a single, positive or negative constant level from 0 V at said material at all times during operation, except during said applied signal applications;

wherein the value of the offset has the same polarity at all times during operation except during signal application; and wherein the offset is applied automatically at all times during operation except during signal application.

2. The liquid crystal device of claim 1 wherein said signal is offset positively or negatively so that a light transmission through said liquid crystal material being driven by said signal is blocked.

3. A liquid crystal device comprising:

a common electrode being formed on an inner surface of either one of two substrates, said two substrates being opposed to each other, said common electrode being single and a common voltage being applied to said common electrode; and a liquid crystal material having spontaneous polarization being filled between said two substrates and being responsive to an applied signal for writing data and controlling a light transmittance of said material, wherein an offset voltage of said signal, corresponding to an image to be displayed and switched, is offset to either a single, positive or negative constant level from 0 V at said material at all times during operation except during said applied signal applications;

wherein the value of the offset has the same polarity at all times during operation except during signal application; and wherein the offset is applied automatically at all times during operation except during signal application.

* * * * *